US009456266B2

(12) United States Patent
Johansen et al.

(10) Patent No.: US 9,456,266 B2
(45) Date of Patent: Sep. 27, 2016

(54) HUMAN LIKE EAR SIMULATOR

(71) Applicant: BRÜEL & KJÆR SOUND & VIBRATION MEASUREMENT A/S, Nærum (DK)

(72) Inventors: Brian Johansen, Copenhagen K (DK); Søren Jønsson, Hvidovre (DK)

(73) Assignee: Brül & Kjær Sound & Vibration Measurement A/S, Nærum (DK)

( * ) Notice: Subject to any disclaimer, the term of this patent is extended or adjusted under 35 U.S.C. 154(b) by 0 days.

(21) Appl. No.: 14/395,383

(22) PCT Filed: Apr. 15, 2013

(86) PCT No.: PCT/EP2013/057823
§ 371 (c)(1),
(2) Date: Oct. 17, 2014

(87) PCT Pub. No.: WO2013/160137
PCT Pub. Date: Oct. 31, 2013

(65) Prior Publication Data

US 2015/0124978 A1 May 7, 2015

Related U.S. Application Data

(60) Provisional application No. 61/639,241, filed on Apr. 27, 2012.

(51) Int. Cl.
*H04R 29/00* (2006.01)
*H04R 1/10* (2006.01)
*H04R 31/00* (2006.01)

(52) U.S. Cl.
CPC ..... *H04R 1/1016* (2013.01); *H04R 31/00* (2013.01)

(58) Field of Classification Search
CPC .. H04R 1/1016; H04R 31/00; H04R 29/001; H04R 25/30; H04R 1/1075; H04R 1/24; H04R 29/00; H04R 29/008; H04R 3/007; H04R 5/027; H04R 2460/13; H04R 2460/17; H04R 25/65; H04R 25/652; H04R 3/04; H04R 5/033; H04R 1/008; H04R 1/225; H04R 1/2842; H04R 1/2857; H04R 1/288; H04R 2225/021; H04R 2225/025; H04R 2225/77; H04R 2430/01; H04R 2460/01; H04R 2460/05; H04R 2460/07; H04R 2460/11; H04M 1/24
USPC ..... 381/58, 26, 380, 56, 60, 74, 98, 1, 17, 381/18, 182, 23.1, 309, 328, 370, 371, 373, 381/55, 72, 71.6, 318, 325, 329, 372, 59, 381/71.7, 109, 111, 151, 317, 326, 340, 381/345, 347, 354, 384, 398, 417, 427, 67, 381/71.13, 99
See application file for complete search history.

(56) References Cited

U.S. PATENT DOCUMENTS 4,251,686 A 2/1981 Sokolich
2010/0065069 A1* 3/2010 Post ..... A61F 9/029 128/866

FOREIGN PATENT DOCUMENTS

EP 0 118 734 9/1984
WO WO 2013/160137 A1 10/2013

OTHER PUBLICATIONS

Hitachi, Ltd., Earphone characteristic measuring device, Mar. 2, 1984.*

(Continued)

*Primary Examiner* — Akelaw Teshale
(74) *Attorney, Agent, or Firm* — Nixon Peabody LLP

(57) ABSTRACT

The present invention relates to an ear simulator representing an average acoustic ear drum impedance of ears of a population of humans. Another aspect of the invention relates to an ear simulator assembly comprising an ear simulator representing average acoustic ear drum impedance and a detachable ear canal simulator to provide an ear simulator assembly representing an acoustic impedance of a human ear canal or average human canals of the population.

19 Claims, 6 Drawing Sheets

(56) References Cited

OTHER PUBLICATIONS

IMpedance of Real and ARtificial Ears, Bruel &Kjaer Aug. 2011.*
International Search Report and Written Opinion in corresponding Application No. PCT/EP2013/057823, mailed Apr. 27, 2012 (10 pages).
S. Gilman and D. Dirks, "Acoustics of Ear Canal Measurement of Eardrum SPL in Simulators," *The Journal of the Acoustical Society of America*, vol. 80, No. 3, Sep. 1, 1986 pp. 783-793, XP009049362.
M. Hipakka and M. Tikander, "Modeling of External Ear Acoustics for Insert Headphone Usage," *J. Audio Eng. Soc.*, vol. 58, No. 4, Apr. 2010, pp. 269-281.

* cited by examiner

A)

B)

A)

B)

A)

B)

HUMAN LIKE EAR SIMULATOR

CROSS-REFERENCE TO RELATED APPLICATIONS

This application is a U.S. National Stage of International Application No. PCT/EP2013/057823, filed Apr. 15, 2013, which claims the benefit of U.S. Provisional Patent Application No. 61/639,241, filed Apr. 27, 2012, both of which are incorporated herein by reference in their entireties.

The present invention relates to an ear simulator representing an average acoustic ear drum impedance of ears of a population of humans. Another aspect of the invention relates to an ear simulator assembly comprising an ear simulator representing average acoustic ear drum impedance and a detachable ear canal simulator to provide an ear simulator assembly representing an acoustic impedance of a human ear canal or average human canals of the population.

BACKGROUND OF THE INVENTION

Today several different types of ear simulators are on the market. These ear simulators are typically used in different situations where it is required to simulate an input/transfer impedance of human ears. A simple so-called 2 cc coupler is used for measuring and verifying acoustic performance parameters of portable electroacoustic or communication equipment such as hearing instruments, head-sets, handsets, ear insert phones etc. during manufacturing. The 2 cc coupler comprises a volume of 2 $cm^3$ of simple geometrical shape providing a rough representation of the input impedance of an average human ear canal.

Several manufacturers offer more advanced types of ear simulators in form of the so-called 711 couplers complying with IEC 60318-4 and ANSI S3.25 standards. One type of 711 coupler is manufactured and marketed by Brüel & Kær Sound and Vibration Measurement A/S under the designation "Ear Simulator—Type 4157".

The 711 type of couplers are constructed to closely reproduce acoustic parameters of average human ear canals by presenting an appropriate input impedance or transfer impedance at a reference measurement plane at which a sound reproducer to be tested is placed. The sound reproducer may comprise an acoustic transducer such as an electro-dynamic, piezoelectric, moving armature loudspeaker of the piece of portable electroacoustic equipment to be tested. The fact that 711 couplers are constructed to closely reproduce acoustic parameters of average human ear canals means that the input impedance or transfer impedance of a 711 coupler is designed to be representative of, or model, a combination of the input/transfer impedance of average human ear drums and the input/transfer impedance of an average human ear canal. These two factors are thus inseparable in any acoustic measurement based on a 711 type ear simulator.

The 4157 ear simulator comprises a main housing assembled of a number of discs whose shapes form annular air volumes coupled to a main volume of the housing by air passages or channels. A ½ inch measurement microphone is mounted at a measurement plane of the main volume to model the position of an eardrum in real human ears. The reference plane of the 4157 ear simulator is located at an entrance of the main volume and as previously mentioned, the position at which the sound outlet of the sound reproducer is placed to ensure the input/transfer impedance of the 4157 ear simulator is accurate. Furthermore, the transversal cross-sectional profile of the main volume of the 711 type ear simulator is oriented substantially parallel to the measurement plane (wherein the diaphragm of the measurement microphone is situated). This orientation of the measurement plane does not accurately mimic the orientation of a human ear drum which is tilted relative to the human ear canal at the intersection between the ear drum and the ear canal.

However, the input impedance or transfer impedance of the 4157 ear simulator, and other 711 type ear simulators, is only considered to be accurate at frequencies up till about 7 kHz. Above this frequency, it has not been possible to verify how well the input or transfer impedance represents the average input or transfer impedance of real human ear canals. The input impedance or transfer impedance of 711 type ear simulators rises abruptly about 13.5 kHz due to a half-wave resonance in a longitudinal dimension of the main volume. This fact is also expressly acknowledged in the IEC 60318-4 and ANSI 83.25 standards which only call for accurate impedance representation till about 8 kHz for compliant ear simulators.

Furthermore, in the frequency range below 8 kHz it has not so far been possible to verify how accurately the acoustic impedance at the measurement plane (or microphone diaphragm position) of the 711 type ear simulator represents the average impedance of human ears at the ear drum, i.e. ear drum impedance. This lack of verification is due to the assumption made when transforming a measured input impedance of human ear into corresponding ear drum impedance. Large errors are easily introduced in this transformation due to a lacking of knowledge of the geometry of the ear canal volume enclosed between the measurement probe and the human ear drum.

The lack of accuracy and unknown performance of the 711 type ear simulators is undesirable in view of a continuing trend of reproducing sound with increased fidelity and frequency extension such as to frequencies above 10 kHz, or even above 12 kHz, in today's portable communication equipment. It would accordingly be highly desirable to provide an ear simulator which accurately represents average input impedance or transfer impedance of real human ear canals so as to allow this type of broad band or high frequency capable portable communication equipment to be properly evaluated.

Furthermore, it would also be highly advantageous to provide an ear simulator assembly that was capable of taking differences in ear canal geometry between different human populations such as infants, children, Asian males etc. into consideration. Such an ear simulator has been provided by the present inventors by firstly measuring and computing the ear canal input impedance of a representative human population throughout an extended frequency range both below and above 16 kHz. Secondly, the present inventors have successfully transformed these broad-band ear canal impedance measurements to corresponding ear drum impedances. Thirdly, by designing an ear simulator ("ear drum simulator") representing the average ear drum impedance of the human population. The present ear drum simulator is highly useful in numerous applications requiring accurate acoustic modeling of human ear canals. For example, the ear drum simulator may be coupled to a detachable or user selectable separate ear canal simulator, representing a known input/transfer impedance of average human ear canals of a target population, or representing a known input/transfer impedance of a particular individual, to provide a flexible ear simulator assembly. This feature makes it possible to construct or assemble a customized ear simulator assembly accurately representing the average ear canal input impedance of the target population or accurately representing the ear canal input impedance of a specific individual.

The customized ear simulator assembly enables accurate prediction of sound amplification and ear drum sound pressure on the specific individual delivered by a piece of portable communication equipment. This property is of considerable advantage in a plurality of applications such as hearing instrument fitting procedures where known ear simulators are solely capable of estimating average sound amplifications and average ear drum sound pressures. These averages may depart considerably from real values on a specific individual or patient due to intra-subject variations in ear canal geometries and input impedances. In hearing instrument fitting procedures, this lack of accuracy is highly undesirable because the hearing impaired user or patient may receive too small or to large sound amplification to adequately compensate for his/hers hearing loss or may be exposed to uncomfortably loud maximum sound pressure levels.

SUMMARY OF INVENTION

According to a first aspect of the invention, there is provided an ear simulator representing an average acoustic ear drum impedance of ears of a population of humans. The ear simulator comprises a sound entrance plane and a sound termination plane. A plurality of air volumes are acoustically coupled to the sound termination plane through respective sound channels. At least one air volume of the plurality of air volumes is situated behind the sound termination plane.

The ability of the present ear simulator or ear drum simulator to model substantially exclusively the average acoustic ear drum impedance of the population of humans instead of modeling the combination of ear drum impedance and ear canal impedance as prior art ear simulators is highly useful in numerous measurement and fitting applications of portable electroacoustic equipment. The present ear drum simulator is for example highly useful as part of an ear simulator assembly that additionally comprises a detachable or user selectable separate ear canal simulator, representing a known input/transfer impedance of average human ear canals of a target population, or representing a known input/transfer impedance of a particular individual. This feature enables the construction of customized ear simulator assemblies accurately representing the average ear canal input impedance of a target population or the ear canal input impedance of a specific individual for accurate prediction of sound amplification and ear drum sound pressure on the specific test person delivered by a piece of portable electroacoustic communication equipment such as hearing instruments, head-sets, in-ear phones of music players, mobile phones etc.

The sound inlet of the sound channel of the at least one air volume is preferably arranged at or in the sound termination plane. Preferably, respective sound inlets of sound channels of one or more additional air volumes are likewise arranged at or in the sound termination plane. In one embodiment, each sound inlet of the sound channel of each air volume of the plurality of air volumes is arranged at or in the sound termination plane. The placement of the one or more sound inlets in or at the sound termination plane provides a direct acoustic coupling between the one or more air volumes and the sound termination plane which leads to several pronounced advantages such as:

1) the sound inlets of the sound channels do not interfere with a geometry of an attached ear canal simulator such that respective acoustic properties of the ear canal simulator and the ear drum simulator are decoupled. This is helpful because acoustic properties of human ear canals vary considerably more than the acoustic impedance of human ear drums;

2) the sound channel location mimics closely the natural acoustic load on the human eardrum naturally provided by the middle ear on human ear drums such that proper representation of the human ear drum impedance is possible also at frequencies above 10 kHz;

3) The one or more air volumes and their associated sound channels and sound inlets are closely spaced in the ear simulator improving the accuracy of the input impedance of the ear simulator at high frequencies.

In a preferred embodiment, the sound entrance plane and the sound termination plane are substantially coincident. This embodiment provides compact ear simulator geometry with substantially zero cavity volume in front of the sound termination plane. Another embodiment of the present ear simulator comprises a frontal cavity of predetermined volume arranged in-between the sound entrance plane and the sound termination plane. In the latter embodiment, a very small cavity volume can still be provided by coupling at least one air volume to the sound termination plane. The predetermined volume of the frontal cavity is preferably smaller than 250 $mm^3$ such as between 2 $mm^3$ and 200 $mm^3$, even more preferably between 5 $mm^3$ and 50 $mm^3$, making the frontal cavity substantially smaller than the main chamber of the 711 type of ear simulator. In one such embodiment, a height of the frontal cavity may correspond to a height one or more of the sounds channels leading to the one or more of the air volumes and lie between 30 μm and 300 μm, such as between 50 μm and 200 μm. In these preferred embodiments of the frontal cavity, the frontal volume is so small that the sound termination and the sound entrance plane are practically co-incident which means that an input impedance of the ear simulator, measured at the sound entrance plane, is substantially equal to the desired average acoustic ear drum impedance at least up till 20 kHz. The frontal cavity preferably possesses a cross-sectional area between 50 $mm^2$ and 200 $mm^2$ such as about 80 $mm^2$. The frontal cavity may have a circular contour, conforming to the diaphragm shape of a ½ inch or ¼ inch measurement microphone, or an oval contour or any other suitable contour.

If the ear drum simulator comprises the above discussed frontal cavity, the respective sound inlet(s) of one or more sound channels of the plurality of air volumes may be arranged between the sound entrance plane and the sound termination plane, i.e. acoustically coupled directly to the frontal cavity.

In another preferred embodiment, the ear simulator comprises a first air volume situated behind the sound termination plane, said first air volume having a first sound channel with a first sound inlet arranged at or in the sound termination plane. Furthermore, a second air volume, with a second sound channel, has a second sound inlet arranged at or in the sound termination plane. The second air volume is preferably arranged behind the sound termination plane. A volume of the first air volume may lie between 0.4 $cm^3$ and 2 $cm^3$ such as about 0.8 $cm^3$.

The latter embodiment of the ear drum simulator preferably comprises a third air volume with a third sound channel having a third sound inlet arranged at or in either the sound termination plane or arranged in the frontal cavity. This embodiment may additionally comprise a fourth air volume with a fourth sound channel having a fourth sound inlet arranged at or in the sound termination plane or arranged in the frontal cavity. According to one such specific embodiment, the first and second air volumes are both situated behind the sound termination plane while at least one of the third and fourth air volumes is situated in front of the sound termination plane.

In an alternative embodiment at least one of the third and fourth air volumes is arranged behind the sound termination plane.

The volume of each of the second and third air volumes preferably lies between 50 $mm^3$ and 1000 $mm^3$, such as about 300 $mm^3$. This range of air volume dimensions is set by certain practical construction considerations to provide an ear simulator with compact dimensions and to allow accurate and reproducible mechanical construction of the ear simulator by known manufacturing techniques such as machining or moulding.

The ear simulator is configured to provide an input impedance magnitude, at the sound entrance plane, of:

$1.08*10^8$ Pa*s/$m^3$+/−3 dB at 200 Hz;

$3.44*10^7$ Pa*s/$m^3$+/−3 dB at 1 kHz;

$4.44*10^7$ Pa*s/m+/−4 dB at 3 kHz;

$9.12*10^7$ Pa*s/$m^3$+/−5 dB at 6 kHz $7.41*10^7$ Pa*s/$m^3$+/−5 dB at 8 kHz $6.41*10^7$ Pa*s/$m^3$+10 dB/−5 dB at 10 kHz.

Since these nominal input impedance magnitude values correspond closely to the measured average acoustic ear drum impedance of the ears of the population of humans, the present embodiment of the ear drum simulator is representative of this average ear drum impedance.

The tolerance values associated with these input impedance values are preferably even narrower such that a more preferred embodiment of the present ear drum simulator is configured to provide an input impedance magnitude, at the sound entrance plane, of:

$1.08*10^8$ Pa*s/$m^3$+/−2 dB at 200 Hz;

$3.44*10^7$ Pa*s/$m^3$+/−2 dB at 1 kHz;

$4.44*10^7$ Pa*s/m+/−3 dB at 3 kHz;

$9.12*10^7$ Pa*s/$m^3$+/−4 dB at 6 kHz;

$7.41*10^7$ Pa*s/$m^3$+/−4 dB at 8 kHz;

$6.41*10^7$ Pa*s/$m^3$+6 dB/−4 dB at 10 kHz.

The existing ear simulators, such as the above-discussed wide-spread IEC 711 type of ear simulators, are unable to attain equivalent acoustic ear drum impedance values within the above mentioned range at all of the listed measurement frequencies as described in additional detail below with reference to FIGS. 4, 5 and 6. Some existing ear simulators may possess an equivalent acoustic ear drum impedance within the listed input impedance range of the present ear simulator at one or two of the listed measurement frequencies, e.g. around 800 Hz and 1 kHz, but fail to provide the listed input impedance values at the residual measurement frequencies such as at 200 Hz and at 4 kHz as described in further detail bellow.

Another aspect of the invention relates to an ear simulator assembly representing an acoustic impedance of a human ear canal or an average of multiple human ear canals, comprising an ear simulator according to any of the above described embodiments thereof and detachable ear canal simulator. The detachable ear canal simulator is acoustically and mechanically connectable to the ear simulator through a canal termination surface at an intersection plane between the ear simulator and the ear canal simulator. The detachable ear canal simulator comprises an elongate sound channel extending between a canal sound entrance plane and the canal sound exit plane. The sound channel may be substantially straight or curved/bent conforming to the typical geometry of human ear canals. The detachable ear canal simulator is a structure which preferably is shaped and sized to model an individual human ear canal or an average human ear canal of a certain population of humans. Consequently, in one embodiment of the present ear simulator assembly the acoustic input impedance of the detachable ear canal simulator represents an average acoustic input impedance of ear canals of a representative population of humans while in another embodiment the acoustic input impedance of the detachable ear canal simulator represents the acoustic input impedance of an ear canal of a single human ear.

According to an advantageous embodiment of the ear simulator assembly the detachable ear canal simulator is coupled to the ear simulator in a manner which results in an angled orientation of the sound termination plane of the ear simulator. This property accurately reflects the angled orientation of a typical human ear drum relative to the accompanying ear canal at the intersection between the eardrum and ear canal. This accuracy of orientation is very helpful in attenuating acoustic reflections between surfaces inside of the enclosed ear canal. According to this embodiment of the ear simulator assembly, the canal termination surface of the detachable ear canal simulator at the intersection plane is tilted at an angle between 10 and 80 degrees, such as between 30 and 60 degrees, relative to a transversal cross-sectional plane through the elongate sound channel at the canal termination surface.

Another embodiment of the present ear simulator assembly comprises a detachable pinna or auricle simulator connectable to an inlet surface at the canal input plane of the detachable ear canal simulator. The detachable pinna or auricle simulator is configured or designed to modeling acoustic impedance characteristics of an average human pinna or acoustic impedance characteristics of a particular human pinna. This embodiment of the present ear simulator assembly is highly useful by providing a complete chain of simulators modeling the acoustic properties of outer hearing system of humans. The skilled person will appreciate that this embodiment of the present ear simulator assembly can be mounted on a suitable head and torso simulator such as the head and torso simulator Type 4128 manufactured by Brüel & Kær Sound and Vibration Measurement A/S.

According to a third aspect of the present the invention, there is provided a detachable ear canal simulator which comprises an elongate sound channel extending between a sound entrance plane and a sound exit plane and having a central longitudinal axis extending there through.

The small dimensions enabled by the construction or design of the present ear drum simulator enables accurate modeling of the average acoustic input impedance of real human ear canals up to a much higher frequency than known ear simulators. The present inventors have, according to another aspect of the present invention, developed methodologies and equipment to accurately measure and compute acoustic ear canal impedances and ear drum impedances of human test subjects as explained below in additional detail. The computed acoustic ear drum impedances have enabled the present inventors to determine average acoustic ear drum impedances for a particular population and develop the novel type of ear simulator of appropriate mechanical and acoustic design. The modeling capability of the present ear drum simulator in combination with its realistic design based on average human ear canal properties allow proper evaluation of acoustic characteristics of broad band or high-frequency enabled portable communication equipment throughout the full audio frequency range from 20 Hz to 20 kHz

BRIEF DESCRIPTION OF THE DRAWINGS

A preferred embodiment of the invention will be described in more detail in connection with the appended drawings, in which.

DESCRIPTION OF PREFERRED EMBODIMENTS

The present determination of individual ear drum impedances of human test subjects may be based on numerous different ear canal scanning methodologies. The methodologies comprise contact-less scanning such as extracting individual geometries of human ear canals by infra-red scanning and/or ultrasound scanning. Other suitable contact-less ear canal scanning methodologies comprise CT scanning of the test subject's ear canal or MR scanning of the test subject's ear canal with a suitable contrast agent injected in the ear canal during MR scan. However, care must be taken to achieve accurate results in view of the current technology state. Another group of ear canal scanning methodologies comprises the application of known ear canal impression techniques. This group may include injecting a wax or similar liquid impression material or agent, such as Silicone Singles® (Silicast in single form) or Silicast®, into the test subject's ear canal where it is hardened and subsequently retracted. The hardened individual ear canal impression may thereafter be scanned for example by an infrared scanner to extract the relevant ear canal dimensions and geometrical features.

Figure 1:
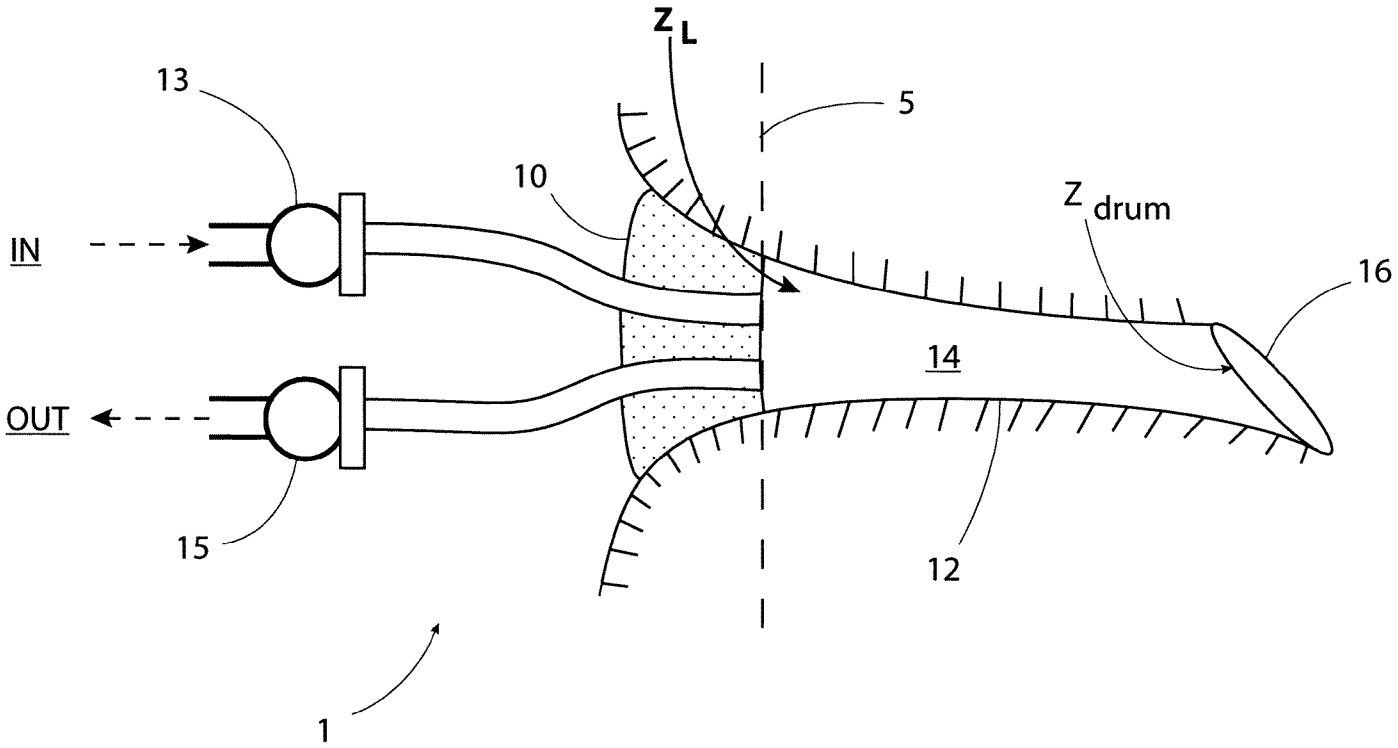
FIG. 1 is a schematic illustration of a measurement set-up for determining individual ear drum impedances of human test subjects.

FIG. 1 illustrates schematically a measurement set-up 1 for determining individual ear drum impedances of human test subjects. An individual customized earmold 10 is positioned in the ear canal 12 of the test subject while two probe tubes are connected respectively to a sound source (transmitter) 13 and a microphone (receiver) 15. The transmitter 6 produces a reference volume velocity, $q_{in}$, and the accompanying or resulting sound pressure $p_{in}$ in the occluded ear canal volume 14 in front of the customized earmold 10 is measured by the receiver 15 via its probe tube connection. The customized earmold 10 is positioned at a suitable location in the test subject's ear canal 12. The tip of the earmold or earplug 10 is preferably located between 10 and 20 mm, such as 15 mm, inside the test subject's ear canal 12 during the measurement procedure.

By applying numerical computing methods or algorithms such as Finite Element Method (FEM) it is possible by utilizing two sets of reference load cavities to calibrate the sound source 13 and receiver 15 assembly to operate in an extended bandwidth to above 20 kHz. By a priory knowledge of the sound source 13 to receiver 15 transfer function, $H_{probe}$, the acoustic input impedance across frequency at the reference plane 5 in front of the sound source 13 inside the subject's ear canal where the earmold tip is positioned can now be calculated as:

$$Z_{in} = H * \frac{p_{in}}{q_{in}}$$

From the determined acoustic input impedance at the reference plane 5 in front of the sound source 13, it is possible by applying numerical computing methods or algorithms such as Finite Element Method (FEM) to compute a an equivalent impedance on a predefined surface in the occluded ear canal volume 14 based on the individual known geometry of the test subject's occluded ear canal volume 14 between the reference plane 5 and the ear drum 16. In particular the acoustic impedance $Z_{drum}$ at the ear drum 16, i.e. the acoustic ear drum impedance. By calculating individual ear drum impedances across frequency for an appropriate group of human test subjects of a particular population, an average acoustic ear drum impedance of ears of the population in question is determinable.

Figure 2:
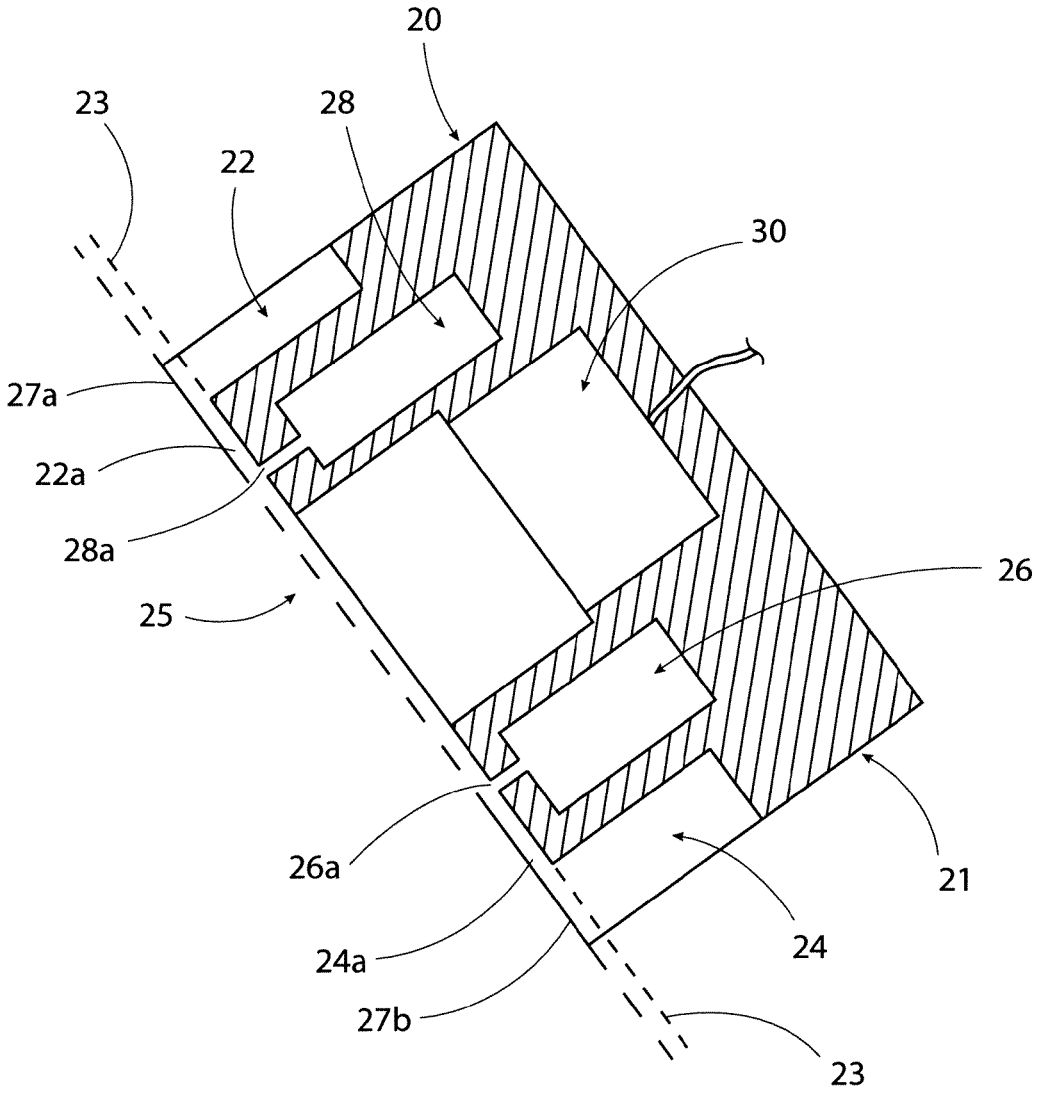
FIG. 2 is a schematic drawing of an ear simulator modeling average acoustic ear drum impedance of a population of human ears in accordance with a first embodiment of the invention.
Figure 3:
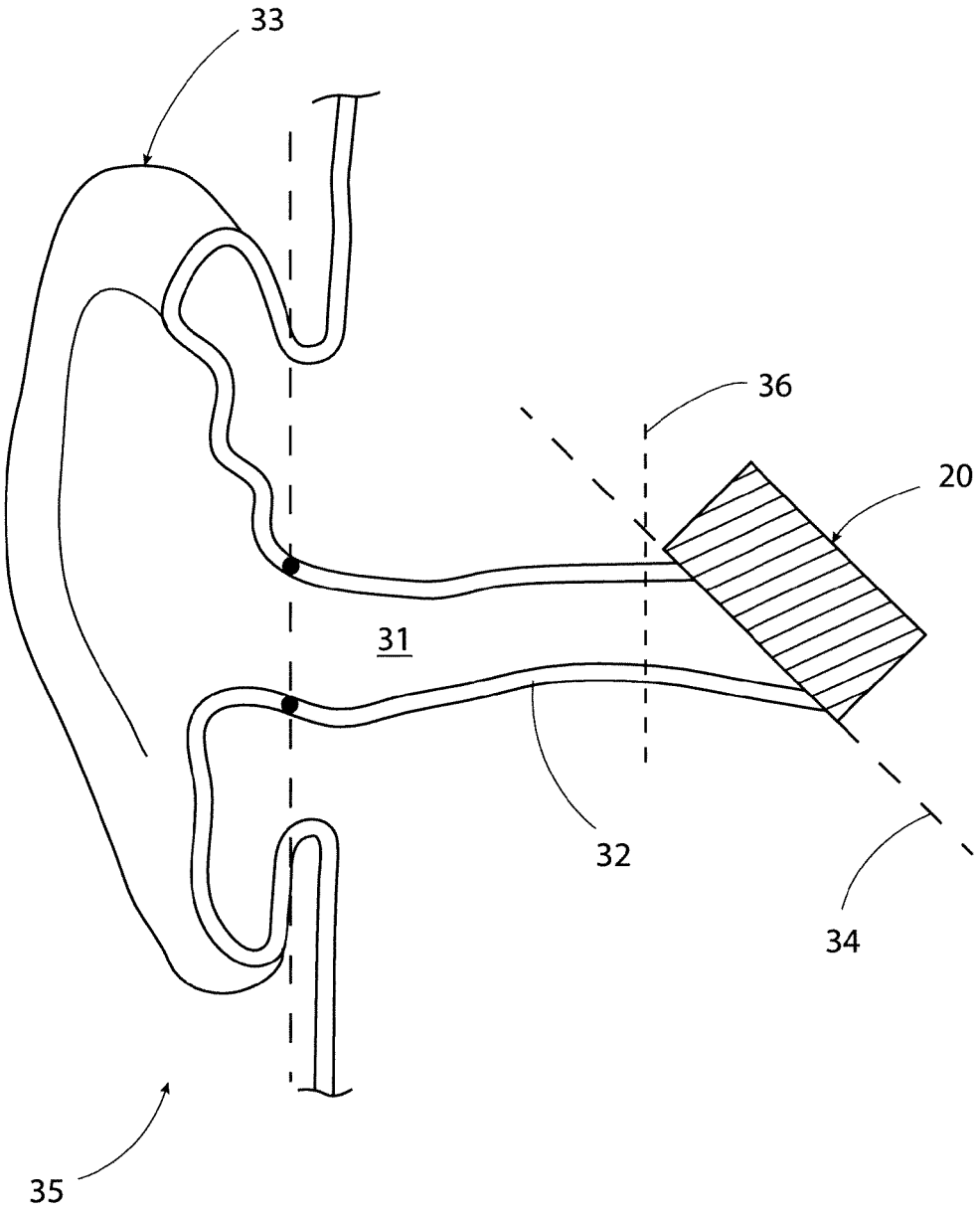
FIG. 3 is a schematic drawing of an ear simulator assembly comprising the ear simulator depicted on FIG. 2, an elongate sound channel and a detachable pinna simulator, FIGS. 4A) and B) show graphs of measured input impedance of an IEC 711 coupler and a computed corresponding ear drum impedance.

FIG. 2 is a schematic central cross-sectional view of an exemplary ear simulator 20 or ear drum simulator modeling the average acoustic ear drum impedance of a population of adult test subjects in accordance with a first embodiment of the invention. The ear simulator 20 comprises a housing 21 and a space for mounting of measurement microphone 30 with a diaphragm (not shown) positioned at a sound termination plane 23 of the ear simulator 20. The measurement microphone 30 may comprise a ½ inch or ¼ inch calibrated measurement microphone. A small frontal cavity extends between the sound termination plane 23 and the sound entrance plane 25. This frontal cavity may have a substantially cylindrical shape and an air volume between 2 $mm^3$ and 200 $mm^3$, preferably an air volume less than 10 $mm^3$ or less than 5 $mm^3$. In one embodiment, a height of the frontal cavity corresponds substantially to a height of the sounds channels 22*a*, 24*a* leading to first and second air volumes or cavities 22 and 24, respectively. This height is preferably between 30 μm and 300 μm such as between 0 μm and 200 μm leading to an extremely low volume of the front chamber such that the sound termination and entrance planes are nearly co-incident. The diaphragm of the measurement microphone 30 is positioned in the sound termination plane 23, and the orientation of the diaphragm may mimic a typical placement of a human ear drum which is tilted relative to the human ear canal at the intersection between the ear drum and the ear canal as illustrated in further detail on FIG. 3. This tilted orientation allows the present ear simulator 20 to model the acoustic ear drum impedance of human ears with increased accuracy at high frequencies when the sound entrance plane 25 of the ear simulator 20 is coupled to an ear canal simulator or structure modeling an individual human ear canal or an average human ear canal as depicted in FIG. 3 below. The sound entrance plane 25 has preferably a circular or oval circumference with an area largely similar to the area of an average human ear drum which typically is about 50 $mm^2$.

In addition to the above-mentioned frontal cavity, the ear simulator 20 comprises four air volumes or cavities 22, 24, 26 and 28 acoustically coupled directly to the sound termination plane 23 through respective sound channels. The four air volumes or cavities 22, 24, 26 and 28 are arranged inside the housing 21 of the ear simulator on both sides of the measurement microphone 30. The skilled person will appreciate that other embodiments of the present ear simulator may comprise only 3 air volumes or more than four air volumes. A first air volume or cavity 22 is acoustically coupled to the sound termination plane 23 through a first sound inlet and the first sound channel 22*a* formed below a first portion of a thin plate-shaped exterior housing surface 27*a*. The first sound inlet is arranged at the sound termination plane 23 at a position adjacent to the microphone diaphragm thereby coupling the first air volume 22 directly to the sound termination plane 23. The first air volume 22 extends through the sound termination plane 23 having a frontal portion arranged in front of the sound termination plane 23 and a rear portion placed behind the sound termination plane 23. A second air volume 24 is also arranged at the sound termination plane 23 and acoustically coupled to the sound termination plane 23 through a second sound inlet and the second sound channel 24*a* formed below a second portion of a thin plate-shaped exterior housing surface 27*b*. The second sound inlet is acoustically coupled to the sound termination plane 23 at a position adjacent to the microphone diaphragm albeit at an opposing side thereof relative to the first sound inlet. Each of the first and second air volumes 22 and 24, respectively, may have a volume between 0.1 $cm^3$ and 0.8 $cm^3$.

A third and fourth cavity or air volume 26, 28, respectively, are coupled directly to the sound termination plane 23 through respective sound channels having respective sound inlets 26*a*, 28*a* arranged in the sound termination plane 23. The third cavity 26 is arranged behind the sound termination plane 23 extending towards a rear side of the housing 21 parallelly with the measurement microphone 30. The third cavity 26 is coupled to the sound termination plane 23 via a sound channel with the sound inlet 26*a* at one end. The fourth cavity 28 is likewise arranged behind the sound termination plane 23 and is coupled directly to the sound termination plane 23 via a sound channel with the sound inlet 28*a* at one end. The fourth cavity 28 is also arranged behind the sound termination plane 23 and extends toward the rear side of the housing 21 parallelly with the measurement microphone 30. The volume of the third cavity 26 is preferably between 0.4 and 2 $cm^3$ while the volume of the fourth cavity 28 preferably lies between 0.05 $cm^3$ and 0.5 $cm^3$.

FIG. 3 is a schematic drawing of an ear simulator assembly comprising the ear drum simulator 20 depicted on FIG. 2, a detachable ear canal simulator 32, shaped as an elongate sound channel, and a detachable pinna simulator 33. The detachable ear canal simulator 31 comprises the elongate sound channel extending between a canal sound entrance plane and the canal sound exit plane at a canal termination surface. The detachable ear canal simulator 31 is acoustically and mechanically couplable to the ear drum simulator 20 via suitable mechanical attachment means arranged on the canal termination surface and mating to corresponding attachment means of the ear drum simulator. The detachable ear canal simulator 31 is shaped and sized for modeling an individual human ear canal or an average human ear canal for example representing the earlier described population of adult test subjects. The ear simulator assembly 35 further comprises the detachable pinna or auricle simulator 33 modeling acoustic impedance characteristics of an average human pinna or acoustic impedance characteristics of a particular human pinna. The detachable pinna simulator 33 is acoustically and mechanically couplable to the detachable ear canal simulator 32 through the previously discussed canal sound entrance plane (not shown) of the ear drum simulator 20. Hence, the ear simulator assembly provides a highly versatile tool for accurate acoustic modeling of both low and high-frequency acoustic properties of specific individuals or modeling low and high-frequency average acoustic properties of a target population of humans.

The ear drum simulator 20 is furthermore attached to the detachable ear canal simulator 31 with a tilted orientation of the sound entrance plane (25 of FIG. 1) which tilted orientation as previously explained mimics the orientation between the typical human ear drum and the ear canal. More specifically, the sound entrance plane of the ear drum simulator 20 is oriented parallel to the depicted intersection plane 34 which is substantially co-incident with the canal sound exit plane of the ear canal simulator 31. The canal termination surface at the intersection plane 34 is tilted at an angle about 45 degrees relative to a transversal cross-sectional plane 36 through the elongate sound channel 31 at the canal termination surface as illustrated. The tilt angle may vary depending on specific construction details of the of the ear drum simulator 20 and the detachable ear canal simulator 31, but is preferably selected to a value between 10 and 80 degrees such as between 30 and 60 degrees.

Figure 4:
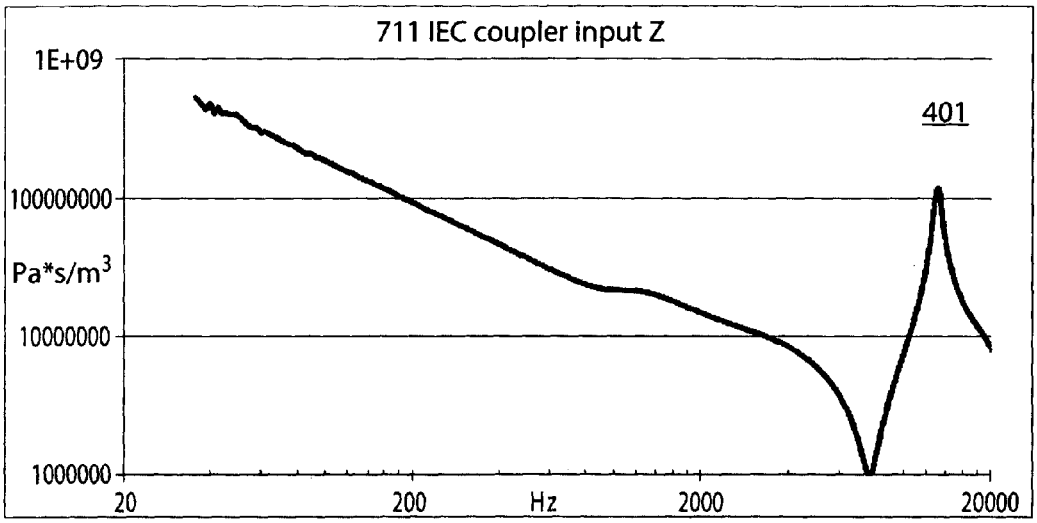
Figure 4:
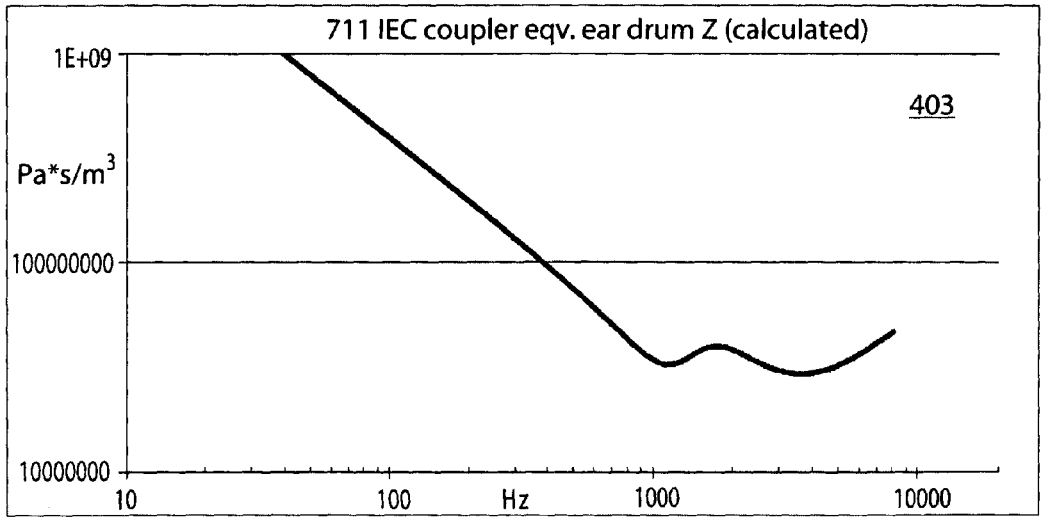

The upper graph 401 of FIG. 4A) shows a measured magnitude of the acoustic input impedance versus frequency of the standardized (IEC) 711 type ear simulator or coupler at the reference plane. The lower graph 403 shows a corresponding computed magnitude of the corresponding "ear drum" acoustic impedance of the IEC 711 type ear simulator.

Figure 5:
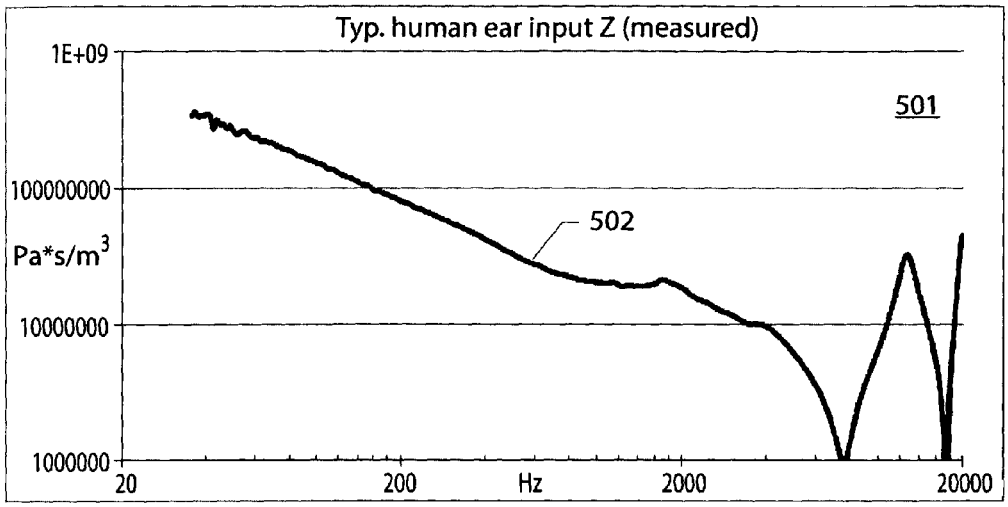
FIG. 5A) shows a graph of an experimentally measured typical input impedance of a human ear canal of an adult individual.
FIG. 5B) shows a graph of computed average ear drum impedance of a human adult test population of 25 individuals, FIG. 6A) shows a graph comparing the experimentally measured average ear drum impedance of human ear canals compared to the computed ear drum impedance of the IEC 711 coupler.
Figure 5:
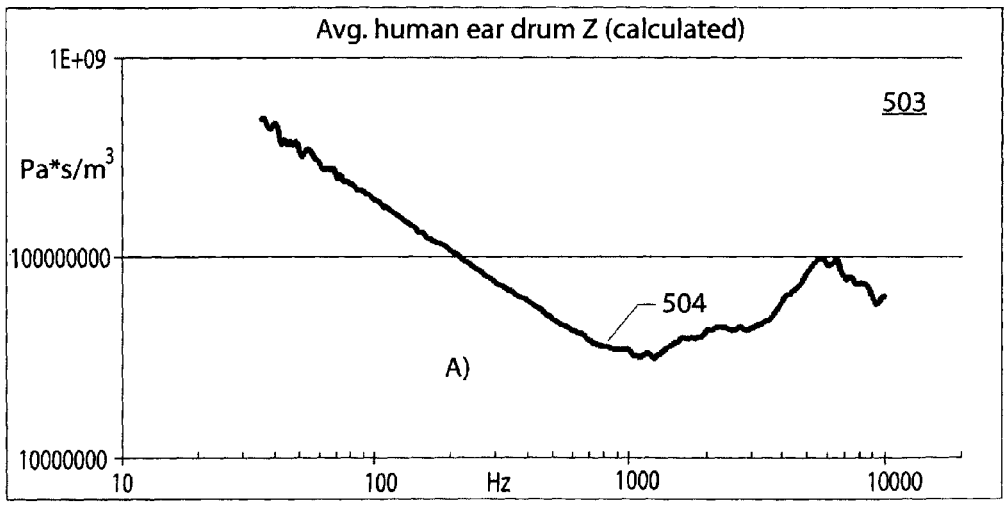

The graph 501 of FIG. 5A) shows an experimentally measured typical ear input impedance magnitude 502 versus frequency at the reference plane (5 of FIG. 1) for a single one of the 25 adult test subjects or individuals. The graph 503 of FIG. 5B) shows the magnitude of the average ear drum impedance 504 as computed from the measured average ear input impedance magnitudes by the previously mentioned FEM methodology.

The average ear drum impedance computations gave the following median (average) values of the magnitude of the impedance:

$3.53*10^8$ Pa*s/$m^3$ at 50 Hz;

$1.08*10^8$ Pa*s/$m^3$ at 200 Hz;

$3.44*10^7$ Pa*s/$m^3$ at 1 kHz;

$4.44*10^7$ Pa*s/m at 3 kHz;

$9.12*10^7$ Pa*s/m$^3$ at 6 kHz $7.41*10^7$ Pa*s/m$^3$ at 8 kHz $6.41*10^7$ Pa*s/m$^3$ at 10 kHz.

Table 1 below lists the experimentally measured average ear input impedance values including the lower and upper magnitude values of the input impedance values within a 95% confidence interval:

TABLE 1

| Frequency (Hz) | Magnitude lower limit (Pa * s/m$^3$) | Magnitude upper limit (Pa * s/m$^3$) |
|---|---|---|
| 50 | $25 * 10^7$ | $51 * 10^7$ |
| 200 | $76 * 10^6$ | $15 * 10^7$ |
| 10000 | $24 * 10^6$ | $48 * 10^6$ |
| 3000 | $28 * 10^6$ | $72 * 10^6$ |
| 6000 | $52 * 10^6$ | $16 * 10^7$ |
| 8000 | $41 * 10^6$ | $13 * 10^7$ |
| 10000 | $28 * 10^6$ | $14 * 10^7$ |

Figure 6:
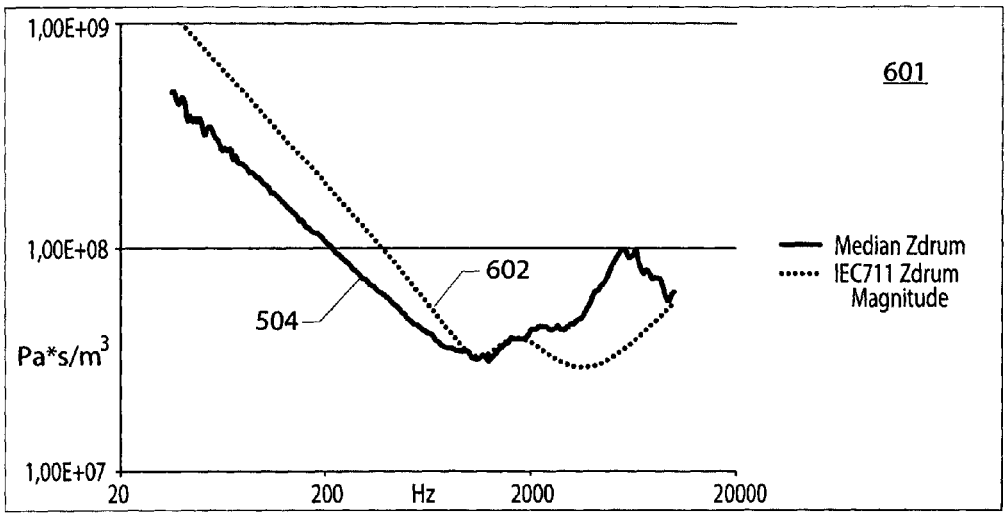
FIG. 6B) shows a graph comparing the upper and lower limits of the experimentally measured average ear drum impedance of human ear canals compared to the computed ear drum impedance of the IEC 711 coupler.
Figure 6:
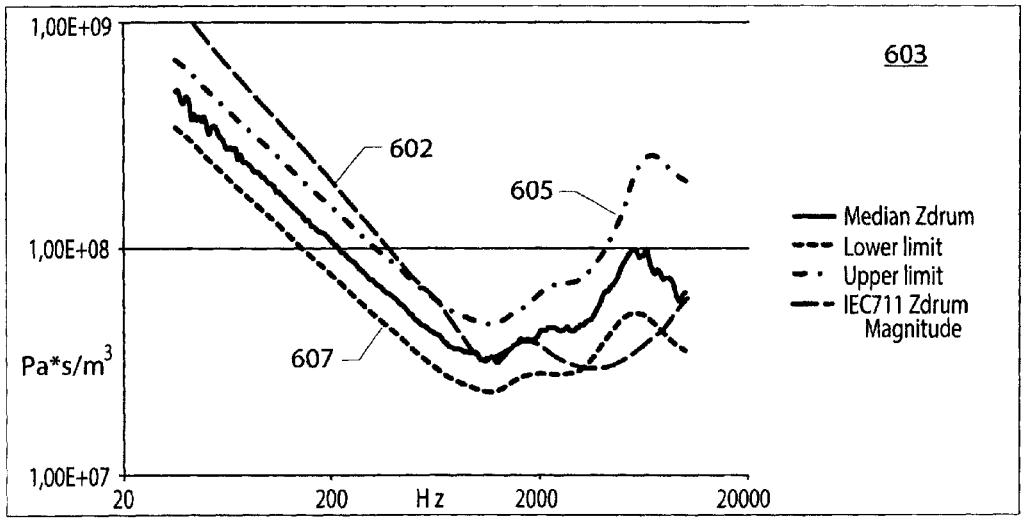

FIG. 6A) is a graph 601 comparing the previously discussed computed magnitude values of the average ear drum impedance depicted on curve 504 to the computed ear drum impedance curve 602 of the IEC 711 coupler. It is evident that the 711 type ear simulator does not accurately model or represent the average ear drum impedance of the tested population of adult humans. Throughout the low frequency range from about 50 Hz to about 1000 Hz the magnitude of the ear drum impedance is overall too high and conversely too low in a frequency range from about 2 kHz to 8 kHz.

FIG. 6B) shows a graph comparing curves of the upper impedance limit 605 and lower impedance limit 607 of the experimentally measured average ear drum impedance of human ear canals compared to the computed ear drum impedance 602 of the IEC 711 coupler. It is evident that the magnitude of the ear drum impedance of the 711 type ear simulator even falls outside these upper and lower impedance limits in a several frequency bands between 50 Hz and 10 kHz.

The invention claimed is:

1. An ear simulator representing an average acoustic ear drum impedance of ears of a population of humans, comprising:

a sound entrance plane and a sound termination plane, a plurality of air volumes acoustically coupled to the sound termination plane through respective sound channels, at least one air volume of the plurality of air volumes being situated behind the sound termination plane, wherein the plurality of air volumes comprises a frontal cavity of predetermined volume arranged in-between the sound entrance plane and the sound termination plane.

2. An ear simulator according to claim 1, wherein the sound entrance plane and the sound termination plane are substantially coincident.

3. An ear simulator according to claim 1, wherein the predetermined volume of the frontal cavity is smaller than 200 mm$^3$ or between 2 mm$^3$ and 200 mm$^3$, or between 5 mm$^3$ and 50 mm$^3$.

4. An ear simulator according to claim 1, comprising:

a first air volume situated behind the sound termination plane, said first air volume having a first sound channel with a first sound inlet arranged at or in the sound termination plane;

a second air volume with a second sound channel which comprises a second sound inlet arranged at or in the sound termination plane.

5. An ear simulator according to claim 4, wherein the second air volume is arranged behind the sound termination plane.

6. An ear simulator according to claim 4, wherein a volume of the first air volume lies between 0.4 cm$^3$ and 2 cm$^3$, or about 0.8 cm$^3$.

7. An ear simulator according to claim 4, comprising:

a third air volume with a third sound channel having a third sound inlet arranged at or in the sound termination plane, or arranged in the frontal cavity.

8. An ear simulator according to claim 7, comprising:

a fourth air volume with a fourth sound channel having a fourth sound inlet arranged at or in the sound termination plane, or arranged in the frontal cavity.

9. An ear simulator according to claim 7, wherein each of the second and third air volumes has a volume between 50 mm$^3$ and 1000 mm$^3$, or about 300 mm$^3$.

10. An ear simulator according to claim 7, wherein at least one of the third or fourth air volumes is arranged behind the sound termination plane.

11. An ear simulator according to claim 9, configured to provide an input impedance magnitude, at the sound entrance plane, of:

$1.08*10^8$ Pa*s/m$^3$+/−3 dB at 200 Hz;

$3.44*10^7$ Pa*s/m$^3$+/−3 dB at 1 kHz;

$4.44*10^7$ Pa*s/m$^3$+/−4 dB at 3 kHz;

$9.12*10^7$ Pa*s/m$^3$+/−5 dB at 6 kHz;

$7.41*10^7$ Pa*s/m$^3$+/−5 dB at 8 kHz;

$6.41*10^7$ Pa*s/m$^3$+10 dB/−5 dB at 10 kHz.

12. An ear simulator according to claim 1, configured to provide an input impedance magnitude, at the sound entrance plane, of:

$1.08*10^8$ Pa*s/m$^3$+/−3 dB at 200 Hz;

$3.44*10^7$ Pa*s/m$^3$+/−3 dB at 1 kHz;

$4.44*10^7$ Pa*s/m$^3$+/−4 dB at 3 kHz;

$9.12*10^7$ Pa*s/m$^3$+/−5 dB at 6 kHz;

$7.41*10^7$ Pa*s/m$^3$+/−5 dB at 8 kHz;

$6.41*10^7$ Pa*s/m$^3$+10 dB/−5 dB at 10 kHz.

13. An ear simulator according to claim 1, wherein the sound entrance plane has a cross-sectional area between 50 and 200 mm$^2$, or about 80 mm$^2$.

14. An ear simulator assembly representing an acoustic impedance of a human ear canal or an average of multiple human ear canals, comprising:

an ear simulator according to claim 1, a detachable ear canal simulator acoustically and mechanically connectable to the ear simulator through a canal termination surface at an intersection plane between the ear simulator and the ear canal simulator, the detachable ear canal simulator comprising an elongate sound channel extending between a canal sound entrance plane and the canal sound exit plane.

15. An ear simulator assembly according to claim 14, wherein an acoustic input impedance of the detachable ear canal simulator represents an average acoustic input impedance of ear canals of a population of humans.

16. An ear simulator assembly according to claim 14, wherein an acoustic input impedance of the detachable ear canal simulator represents an acoustic input impedance of an ear canal of a single human ear.

17. An ear simulator assembly according to claim 14, wherein the canal termination surface of the detachable ear canal simulator at the intersection plane is tilted at an angle between 10 and 80 degrees, or between 30 and 60 degrees, relative to a transversal cross-sectional plane through the elongate sound channel at the canal termination surface.

18. An ear simulator assembly according to claim 14, further comprising a detachable pinna or auricle simulator connectable to an inlet surface at the canal input plane of the detachable ear canal simulator, the detachable pinna or auricle simulator modeling acoustic impedance characteristics of an average human pinna or acoustic impedance characteristics of a particular human pinna.

19. A detachable ear canal simulator comprising:

an elongate sound channel extending between a sound entrance plane and a sound exit plane and having a central longitudinal axis extending there through; and mechanical attachment means arranged on a canal termination surface at the sound exit plane and mating to corresponding attachment means of an ear simulator according to claim 1.

* * * * *